United States Patent [19]

Krivanek

[11] Patent Number: 4,743,756

[45] Date of Patent: May 10, 1988

[54] PARALLEL-DETECTION ELECTRON ENERGY-LOSS SPECTROMETER

[75] Inventor: Ondrej L. Krivanek, Oakland, Calif.

[73] Assignee: Gatan Inc., Pleasanton, Calif.

[21] Appl. No.: 83,629

[22] Filed: Aug. 10, 1987

[51] Int. Cl.[4] ..... H01J 49/44

[52] U.S. Cl. ..... 250/305; 250/396 ML; 250/396 R

[58] Field of Search ..... 250/305, 396 ML, 396 R

[56] References Cited

U.S. PATENT DOCUMENTS 3,541,328 11/1970 Enge ..... 250/305
4,174,479 9/1979 Boerboom ..... 250/292

OTHER PUBLICATIONS

Crewe, Isaacson & Johnson, A high resolution electron spectrometer for use in transmission scanning electron microscopy, Rev. Sci./wk. 42(4), 411∝420.
Sherman & Koust, Quantitative data processing of parallel recorded electron energy loss spectra with low signal to background, Rev. Sci./wk. 56(2), 231–239.
Johnson, Csillay, Monson & Stern, A photodiode, parallel detection system for energy loss spectrometry, 39th Annual EMSA meeting Proc.
Design of a Parallel detection system for EELS, Egerton, 39th Annual EMSA meeting Proc.

*Primary Examiner*—Craig E. Church
*Assistant Examiner*—Jack I. Berman

[57] ABSTRACT

Quadrupole electron lenses 21, 22, 23 and 24 are disposed between an energy-dispersing device 15 and a parallel detector 50 in an electron energy-loss spectrometer. The power and polarity of the quadrupole lenses may be adjusted to simultaneously provide the desired energy dispersion of the spectrum, and a precise match between the width of the spectrum and the width of the parallel detector. Additional quadrupole lenses may be interposed between quadrupole lens 24 and the detector 50 to further increase the energy dispersion.

11 Claims, 7 Drawing Sheets

PARALLEL-DETECTION ELECTRON ENERGY-LOSS SPECTROMETER

BACKGROUND OF THE INVENTION

1. Field of the Invention

The invention relates to a parallel-detector electron energy-loss spectrometer including a device for dispersing electrons according to their energy such as a magnetic sector, a parallel electron detector consisting of several detection elements, and several quadrupole electron lenses.

2. Description of Prior Art

Modern electron microscopes are capable of imaging individual atoms in a thin sample, but the images produced by the microscope alone contain no direct information on the chemical composition of the sample. The composition can be determined by producing and analysing the spectrum of characteristic energy losses experienced by the electron beam as it traverses the sample. Consequently, an electron energy-loss spectrometer is a widely used attachment to an electron microscope.

Since the electron beam gradually erodes the thin sample by a process known as radiation damage, an important consideration for an electron energy-loss spectrometer is the efficiency with which it can detect the energy-loss spectra. An efficient method for detecting the spectra is to employ a detector consisting of several detection elements which operate simultaneously. Devices which can be used in this role include photographic plate or film directly exposed to the electron beam, or a scintillator which converts the electrons into a light image which is in turn detected by a TV camera, a photodiode array, or a charge-coupled device array. The devices are often described as parallel detectors, and electron energy-loss spectrometers employing parallel detectors are known as parallel-detection electron energy-loss spectrometers.

The parallel detectors require that the magnification (dispersion) of the spectra be larger than can be reasonably produced by an energy-dispersing device such a magnetic sector, and that the magnification of the spectra be variable in the energy-dispersion direction. In prior art parallel-detection electron energy-loss spectrometers, round electron lenses were used to increase and vary the magnification of the spectra. A major disadvantage of such prior art devices was that they were unable to vary independently the magnification of the spectrum in the dispersion direction, and the width of the spectrum in the direction perpendicular to the dispersion direction. Accordingly, when these devices were adjusted to produce large energy dispersion, the width of the energy spectrum also became large, and a part of the spectrum fell outside the active area of the detector. Useful electron signal was therefore lost, which decreased the efficiency of the analysis. Conversely, at small energy dispersions the width of the spectrum became small, and the electron beam was concentrated on a small area of the detector. This resulted in an unnecessarily high intensity of the electron beam per unit area of the detector. The high electron intensity typically produced a high rate of radiation damage in the detector, and shortened the useful life of the detector. Futher, round lenses rotated the spectra by an angle which varied with the magnification of the spectra. This complicated the mechanical construction of the spectrometer, because the detector had to be rotatable so as to remain aligned with the energy-dispersion direction.

SUMMARY OF THE INVENTION

The present invention solves the problems associated with the use of round lenses by employing a set of quadrupole lenses to increase the dispersion of the electron energy-loss spectrum. The use of the quadrupole lenses leads to a parallel-detection electron energy-loss spectrometer in which the dispersion of the electron energy spectrum can be varied as desired, while the width of the spectrum remains precisely matched to the width of the active area of the parallel detector.

According to the invention, three or more magnetic or electrostatic quadrupole electron lenses of variable power and polarity are disposed between an energy-dispersing device such as a magnetic sector or an electrostatic sector, and a parallel detector. The power and the polarities of the quadrupole lenses may be adjusted so that the energy dispersion of the spectrum, that is the distance by which electron beams of different energies are separated at the detector, the width of the spectrum perpendicular to the dispersion direction, and the focussing of the spectrum in the dispersion direction, that is the condition whereby all electrons of the same energy arrive at the same detector element, can all be adjusted independently. As a result of such adjustments, parts of the electron energy-loss spectrum of variable energy span but of constant width can be projected onto the parallel detector, and detected without any electrons falling outside the active area of the detector, and without unnecessary irradiation damage occuring at the detector due to a high concentration of a narrow electron beam.

A futher advantage of the present invention is that magnetic quadrupole lenses are typically 10 times lighter than magnetic round lenses of comparable strength, and that magnetic quadrupole lenses consume typically 100 times less power to achieve the same strength as magnetic round lenses. Quadrupole lenses also produce no rotation of the spectrum, which simplifies the mechanical construction of the spectrometer.

Another major advantage of the present invention is that it leads to an operating regime in which three of the quadrupole lenses produce completely different effects on the dispersed energy spectrum. One quadrupole primarily determines the focussing the spectrum in the dispersion direction. Another quadrupole primarily affects the the width of the spectrum. Yet another quadrupole determines the energy dispersion of the spectrum without having any strong effect on the width or the focussing of the spectrum. A similar operating regime does not exist if round lenses are used to magnify the energy dispersion. Compared to prior art, the separation of lens action leads to simplified alignment of the quadrupole lenses, and simplified design of the lens power supplies.

BROAD DESCRIPTION OF THE DRAWINGS

For a better understanding of the present invention, reference may be had to the following detailed description taken with the accompanying drawings in which.

DRAWING REFERENCE NUMERALS

Figure 1:
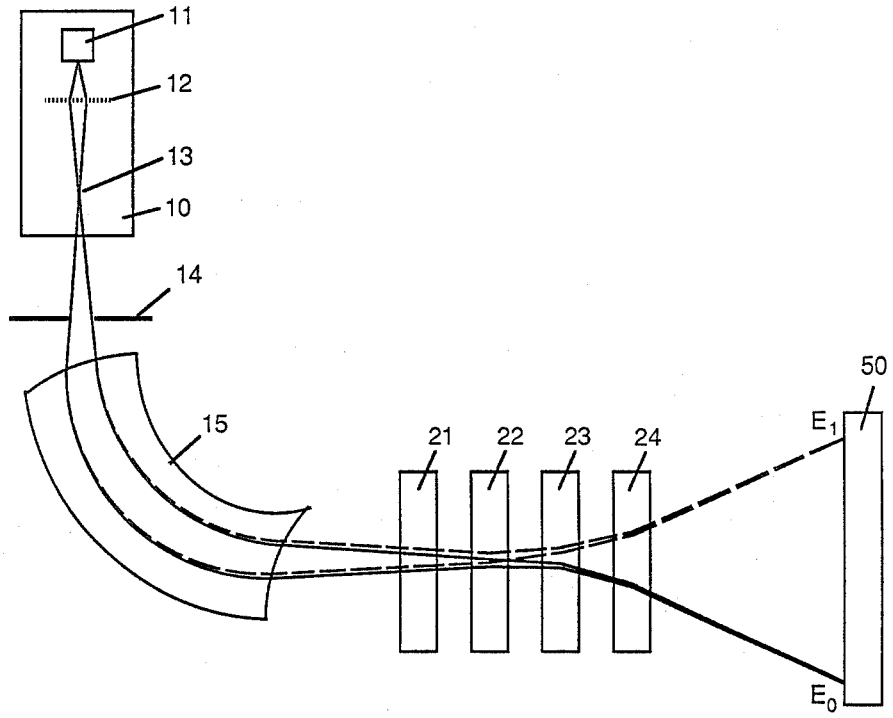
FIG. 1 shows a schematic diagram of a parallel-detection electron energy-loss spectrometer according to the present invention.

10 electron microscope column
11 electron gun
12 specimen
13 electron beam crossover
14 aperture
15 energy-dipersing device
21 quadrupole lens
22 quadrupole lens
23 quadrupole lens
24 quadrupole lens
31 electron beam crossover
32 electron beam crossover
33 electron arrival point
34 electron arrival point
35 electron arrival point
36 electron arrival point
41 location of virtual spectrum
42 location of virtual spectrum
43 location of virtual spectrum
44 location of real spectrum
50 parallel detector
60 magnetic pole
61 coil
62 bobbin
63 current leads
64 magnetic yoke
65 drift tube
70 zero-loss peak
71 silicon K-edge

DETAILED DESCRIPTION OF THE PREFERRED EMBODIMENTS

Referring to FIG. 1, the parallel-detection electron energy-loss spectrometer comprises an energy-dispersing device 15 which disperses electrons according to their energy, four magnetic quadrupole lenses 21,22,23, and 24, and a parallel detector 50. The electrons originate from an electron gun 11 inside an electron microscope column 10. They pass through a thin specimen 12 and are focussed into a final crossover 13, which is typically located in the back-focal plane of the final lens of the electron microscope. Depending on the operating regime of the electron microscope, the electron beam produced by the electron gun typically has a mean energy between 20 keV and 1 MeV, and an energy spread of around 1 eV. On passing through the thin specimen 12, the electrons suffer various energy losses characteristic of the elements present in the sample, and the electron beam emerging from the microscope contains electrons of energies ranging from the high primary energy down to zero energy. The part of the electron energy spectrum most useful for chemical analysis ranges from the primary energy down to primary energy minus about 5 keV.

The angular width of the the electron beam entering the energy-dispersing device 15 is defined by an aperture 14. The preferred energy-dispersing device 15 is a magnetic sector whose entrance and exit polefaces are at such angles to the electron beam, and of such curvatures, that its energy resolution remains better than 1 part in 100,000 for beams of angular width of several mrads, and that the focal plane of the dispersed energy spectrum lies at right angle to the direction of electron travel. The energy dispersion of the spectrum produced by the magnetic sector alone depends on the bending radius of the magnetic sector and on the primary energy of the electron beam, and is typically 0.5 to 5 $\mu$m per 1 eV. The quadrupoles 21 to 24 magnify the dispersed spectrum and project it onto the parallel detector 50 such that the spatial separation between two beams of energies differing by 1 eV can be varied typically from 10 $\mu$m to 10 mm/eV.

Figure 2:
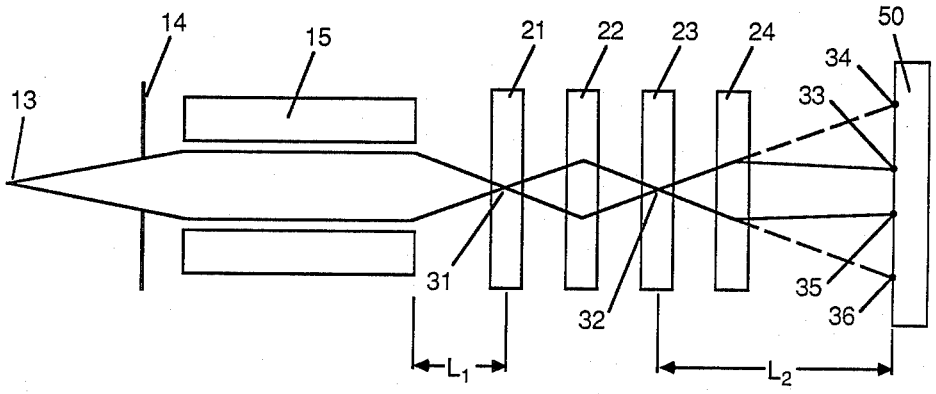
FIG. 2 shows the electron trajectories through the spectrometer in a plane perpendicular to the energy-dispersion plane.

FIG. 2 illustrates the preferred arrangement of quadrupole lenses 21 to 24 by showing the electron trajectories in the plane perpendicular to the energy-dispersion plane, i.e. in the plane which contains the central electron ray and is perpendicular to the plane of FIG. 1. The trajectories shown are those of electrons of the maximum angular deviation from the central ray permitted by the aperture 14. The focussing strength of the energy-dispersing device 15 and the distance $L_1$ between the energy-dispersing device 15 and the quadrupole lens 21 is chosen so that there is a beam crossover 31 at the center of the lens 21. The strength and polarity of the quadrupole lens 22 is then adjusted so that the crossover 31 is reproduced in crossover 32 located at the center of the quadrupole lens 23. The result of this arrangement is that the strengths and polarities of quadrupole lenses 21 and 23 may be varied arbitrarily without any first-order effect on the electron trajectories in the non-dispersion plane.

The strength and polarity of the quadrupole lens 24 is adjusted so that the width of the spectrum, that is the distance between the extreme electron arrival points 33 and 35 at the parallel detector 50, matches the width of the active area of the detector. The width of the spectrum may also be adjusted without altering the location of the crossovers 31 and 32 in a quadrupole arrangement which omits the fourth quadrupole 24. In this case, the distance of the third quadrupole 23 from the parallel detector 50 is chosen such that the separation between the electron arrival points 34 and 36 matches the active area of the detector.

Figure 3:
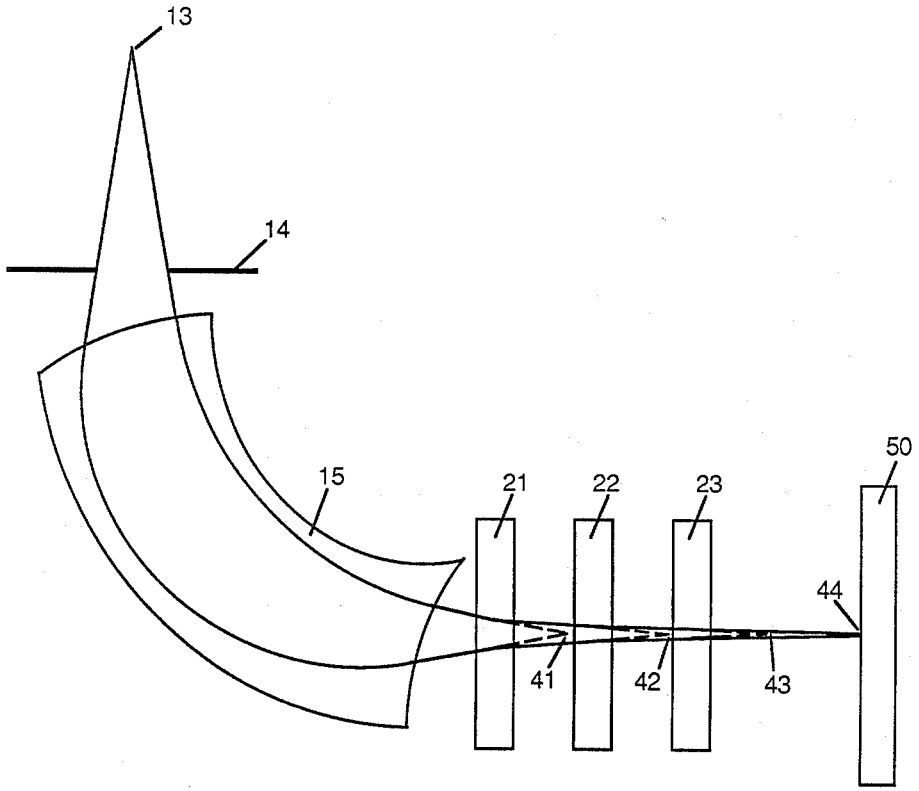
FIG. 3 shows the trajectories of electrons of the same energy but different angular deviation in the energy-dispersion plane.

FIG. 3 illustrates the preferred arrangment of the quadrupole lenses by showing, for the case of three quadrupoles, the trajectories of electrons of the same energy but different angles in the dispersion plane. The polarities of both the quadrupole lenses 22 and 23 are such that they increase the divergeance of the electron beam in the dispersion plane. Accordingly, electrons which would have been focussed into a sharp line 43 perpendicular to the dispersion plane if quadrupole lens 23 were switched off, are focussed into a sharp line 44 at the detector 50. Similarly, quadrupole lens 22 transfers a line of virtual focus at location 42 to location 43, and quadrupole lens 21 transfers a line of virtual focus produced by the energy-dispersing device 15 at location 41 to location 42. In a rough approximation, this results in an increase of the energy dispersion by a factor of $(L_{12}\times L_{23}\times L_{34})/(L_{11}\times L_{22}\times L_{33})$, where $L_{IJ}$ is the distance between the center of the quadrupole 21 and the virtual focus 4J. The excitation of the quadrupole 22 is determined by the focussing requirements in the plane perpendicular to the dispersion plane as described above. The excitation of the quadrupole 23 may be varied as desired to produce a range of energy dispersions. This produces a small charge in the focussing of the dispersed spectrum at the parallel detector 50. However, this change can be exactly compensated by changing the strength of the freely adjustable quadrupole 21.

Figure 4:
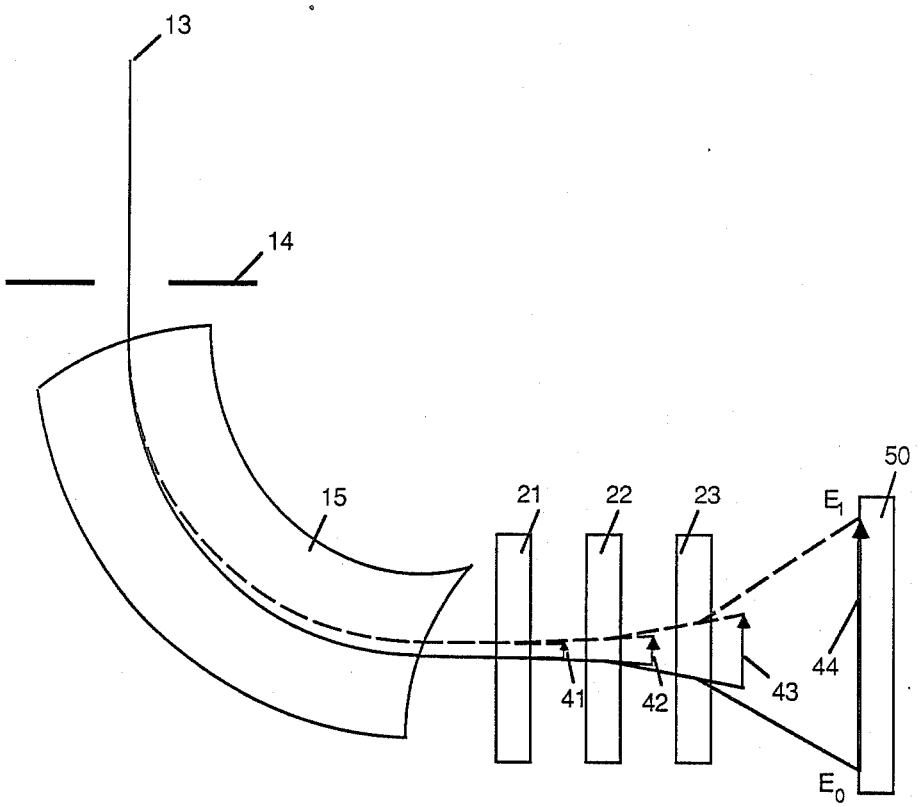
FIG. 4 shows the trajectories of electrons of two different energies in the dispersion plane.

FIG. 4 illustrates how the energy dispersion is progressively increased by the action of the quadrupole lenses by showing the dispersion-plane trajectories of two electrons of different energies $E_0$ and $E_1$, which enter the energy-dispersing device 15 along the same trajectory. In the absence of any quadrupoles, the energy-dispersing device 15 would produce a focussed spectrum of small energy dispersion at location 41. The action of the quadrupole lenses increases the energy dispersion by forming intermediate virtual spectra at locations 42 and 43, and the final energy spectrum on the detector 50.

Figure 5:
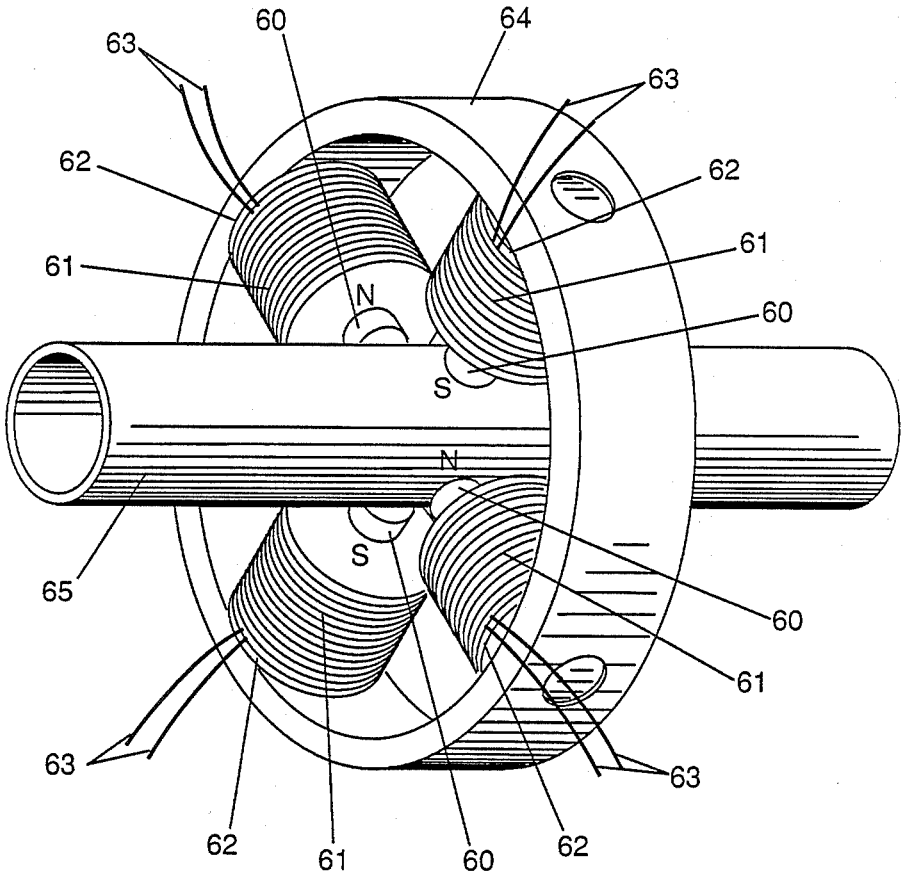
FIG. 5 shows a perspective view of an embodiment of the magnetic quadrupole lens.

FIG. 5 shows an embodiment of a magnetic quadrupole lens suitable for any of the quadrupole lenses 21 through 24. The embodiment comprises four electromagnetic coils 61 wound onto bobbins 62, each coil having a magnetic pole 60 made from a soft magnetic material. The poles 60 are arranged at 90° to each other, and each pole axis makes an angle of 45° with respect to the energy-dispersion plane. The electromagnetic coils are supplied with a variable current through leads 63 in such manner that they are excited equally in strength, but alternate in polarity so that coils at 180° to each other produce two south poles facing each other, and the remaining two coils produce two north poles. The return path for the magnetic field is provided by a magnetic yoke 64. Electrons pass through the quadrupole via a drift tube 65, which is made from a non-magnetic material, and is evacuated.

Figure 6:
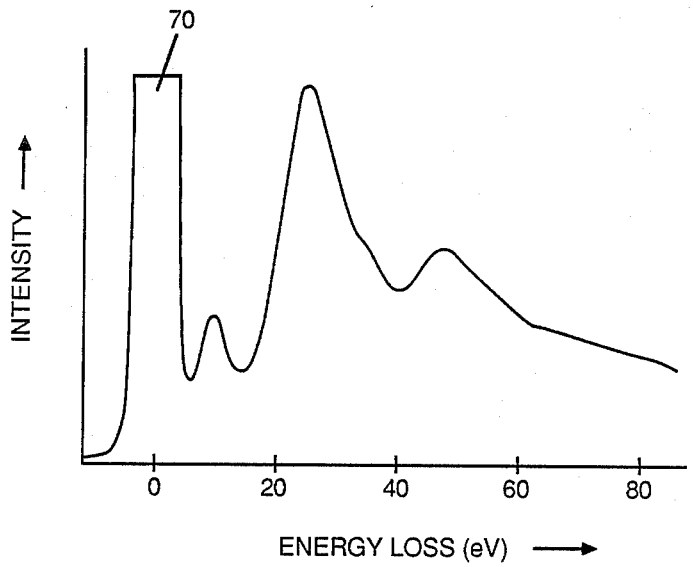
FIG. 6 shows part of the electron energy-loss spectrum of boron nitride taken with the spectrometer of the invention.
Figure 7:
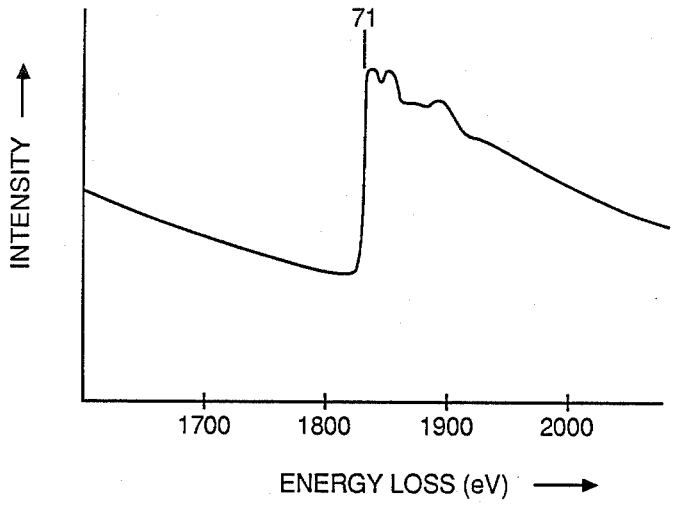
FIG. 7 shows part of the electron energy-loss spectrum of silicon taken with the spectrometer of the invention.

FIGS. 6 and 7 show electron energy-loss spectra produced with the parallel detection electron energy-loss spectrometer of the invention. In this spectrometer, the parallel detector comprises an electron scintillator fiber-optically coupled to a photodiode array of 1024 independent detector elements. Each element is 2.5 mm wide in the non-dispersion direction, and 25 $\mu$m high in the dispersion direction. This gives a total active area of the detector of 25.6 mm in the energy-dispersion direction by 2.5 mm in the perpendicular direction.

FIG. 6 shows an energy-loss spectrum from a thin crystal of boron nitride, which was acquired in 12 millisecond exposure time. As usual in electron energy-loss spectroscopy, the majority of electrons reached the detector without having experienced any energy loss, and formed an intense zero-loss peak 70. The peak saturated the detector, and would have caused irrepairable damage to the scintillator if focussed into a sharp point. However, the quadrupole arrangement of the invention spread the peak into a narrow line whose length matched the 2.5 mm active width of the detector, and there was no observable damage.

FIG. 7 shows a spectrum from a thin crystal of silicon obtained with 1 nA incident beam current in 1 second, at an overall detection efficiency greater than 0.5. The absorption edge 71 at 1839 eV energy loss is the silicon K-edge, whose cross-section is relatively weak. Recording the silicon K-edge with a less efficient electron energy-loss spectrometer would have necessitated prolonging the exposure time, and would have resulted in more damage to the silicon crystal.

While the above contains many specificities, the reader should not construe these as limitations on the scope of the invention, but merely as exemplifications of the preferred embodiment thereof. Those skilled in the art will envision many other possible variations within its scope. For example, it will be apparent to those skilled in the art that additional alignment dipoles may be disposed between the electron microscope column and the energy-dispersing device, and between the energy-dispersing device and the parallel detector, and that likewise aberration-correcting sextupole lenses may be disposed between the electron microscope column and the energy-dispersing device, and between the energy-dispersing device and parallel detector, without changing the first-order focussing and energy-dispersion properties of the invention. It will also be apparent to those skilled in the art that quadrupole lenses may be disposed between the microscope column and the energy-dispersing device, where they may serve to finely tune the first-order focussing of the energy-dispersing device, and that additional quadrupole lenses may be disposed between the energy-dispersing device and the parallel detector, where they may serve to futher increase the energy dispersion of the spectra projected onto the parallel detector.

What is claimed is:

1. An apparatus for producing and detecting an energy spectrum of electrons, comprising:

(a) a means for producing a beam of electrons of various energies;

(b) an energy-dispersing device dispering said beam into an energy spectrum of small energy dispersion;

(c) a parallel detection means detecting a range of energies of said spectrum simultaneously;

(d) a plurality of variable-power quadrupole lenses, of which at least two are strong quadrupole lenses having focal lengths which are shorter than the distance from said energy -dispersing device to the one of said quadrupole lenses which is closest to said energy-dispersing device, said quadrupole lenses being disposed between said energy-dispersing device and said detecting means, and projecting a focused and magnified image of said spectrum onto said detection means; and (e) a means for changing the strength of said quadrupole lenses such that the energy dispersion and width of the focused spectrum are freely adjustable and independent.

2. An apparatus as claimed in claim 1 in which said energy-dispersing device is a magnetic sector.

3. An apparatus as claimed in claim 1 in which said quadrupole lenses are electromagnetic quadrupole lenses.

4. An apparatus as claimed in claim 1 in which one or more alignment dipole lenses are disposed between said energy-dispersing device and said parallel detector.

5. An apparatus as claimed in claim 1 in which one or more aberration-cancelling sextupole lenses are disposed between said energy-dispersing device and said parallel detector.

6. An apparatus for producing and detecting an energy spectrum of electrons, comprising:

(a) a means for producing a beam of electrons;

(b) an energy-dispersing device dispersing said beam into an energy spectrum of small energy dispersion;

(c) a parallel detection means extending linearly in the direction of said energy dispersion and detecting a range of energies of said spectrum simultaneously;

(d) a plurality of quadrupole lenses of which at least two are strong quadrupole lenses having focal lengths which are shorter than the distance from said energy-dispersing device to the one of said quadrupole lenses which is closest to said energy-dispersing device, said quadrupole lenses being disposed between said dispersing device and said detecting means, and projecting a focused and magnified image of said spectrum onto said detection means; and (e) a means for changing the strength of said quadrupole lenses, said means energized to produce a crossover of said electron beam in the direction perpendicular to said dispersion direction near the center of one of the strong quadrupole lenses, such that changing the strength of said one strong quadrupole lens changes the magnification of the spectrum projected onto said detection means without affecting the width of the spectrum, and changing the strength of remaining quadrupole lenses changes the width and focusing of the spectrum.

7. An apparatus as claimed in claim 6 in which said energy-dispersing device is a magnetic sector.

8. An apparatus as claimed in claim 6 in which said quadrupole lenses are electromagnetic quadrupole lenses.

9. An apparatus as claimed in claim 6 in which one or more alignment dipole lenses are disposed between said energy-dispersing device and said parallel detector.

10. An apparatus as claimed in claim 6 in which one or more aberration-cancelling sextupole lenses are disposed between said energy-dispersing device and said parallel detector.

11. An apparatus for producing an electron energy-loss spectrum comprising a source of a beam of electrons, a magnetic sector dispersing said beam of electrons into an energy spectrum of small energy dispersion, a parallel detector extending linearly in the direction of said energy dispersion, and three or more magnetic quadrupole lenses of adjustable power, at least two of said quadrupole lenses having focal lengths which are shorter than the distance from said magnetic sector to the one of said quadrupole lenses which is closest to said magnetic sector, said quadrupole lenses being interposed between said magnetic sector and said parallel detector, and arranged to magnify said energy spectrum produced by said magnetic sector and to project said spectrum onto said parallel detector such that the energy dispersion and width of said projected spectrum may be varied independently of each other while said projected spectrum remains precisely focused onto said parallel detector.

* * * * *